US011802411B2

(12) United States Patent
Merrick

(10) Patent No.: US 11,802,411 B2
(45) Date of Patent: Oct. 31, 2023

(54) SIDING WITH INTEGRATED RAINSCREEN FOR CONCRETE WALL OR BLOCK CONSTRUCTION

(71) Applicant: LOUISIANA-PACIFIC CORPORATION, Nashville, TN (US)

(72) Inventor: Gareth Paul Merrick, Gig Harbor, WA (US)

(73) Assignee: LOUISIANA PACIFIC CORP., Nashville, TN (US)

( * ) Notice: Subject to any disclaimer, the term of this patent is extended or adjusted under 35 U.S.C. 154(b) by 0 days.

(21) Appl. No.: 17/671,805

(22) Filed: Feb. 15, 2022

(65) Prior Publication Data

US 2022/0170273 A1 Jun. 2, 2022

Related U.S. Application Data

(63) Continuation of application No. 16/830,003, filed on Mar. 25, 2020, now Pat. No. 11,248,379.

(60) Provisional application No. 62/831,809, filed on Apr. 10, 2019, provisional application No. 62/823,015, filed on Mar. 25, 2019.

(51) Int. Cl.

| | |
|---|---|
| ***E04F 13/08*** | (2006.01) |
| ***E04F 13/00*** | (2006.01) |
| ***E04F 13/22*** | (2006.01) |

(52) U.S. Cl.
CPC ..... *E04F 13/0803* (2013.01); *E04F 13/007* (2013.01); *E04F 13/22* (2013.01)

(58) Field of Classification Search
CPC ..... E04F 13/0803; E04F 13/007; E04F 13/22; E04F 13/0819
See application file for complete search history.

(56) References Cited

U.S. PATENT DOCUMENTS

| | | | | |
|---|---|---|---|---|
| 3,636,669 A * | 1/1972 | Attkisson | E04B 2/80 | 52/510 |
| 8,387,326 B2 * | 3/2013 | Culpepper | E04F 13/088 | 52/510 |
| 2012/0272603 A1 * | 11/2012 | Carbines | E04F 13/0892 | 52/748.1 |

* cited by examiner

*Primary Examiner* — Patrick J Maestri
(74) *Attorney, Agent, or Firm* — Wayne Edward Ramage; Baker Donelson

(57) ABSTRACT

A wood or manufactured wood-composite based siding used on concrete wall or concrete masonry unit (CMU, or block) construction (including, but not limited to, insulated concrete form construction) with an integrated rainscreen feature. The rainscreen feature or component is applied to, or integrated into or with, the back of the siding (i.e., the inner surface) during the manufacturing process, or in a secondary process thereafter. The features may include raised elements, strips, ridges, or wedges, with one or more channels or spaces. No job-site assembly is required, thereby reducing time and cost.

9 Claims, 18 Drawing Sheets

(not to scale)

(not to scale)

(not to scale)

(not to scale)

(not to scale)

(not to scale)

SIDING WITH INTEGRATED RAINSCREEN FOR CONCRETE WALL OR BLOCK CONSTRUCTION

This application is a continuation of U.S. patent application Ser. No. 16/830,003, filed Mar. 25, 2020, which claims benefit of and priority to U.S. Provisional Applications Nos. 62/823,015, filed Mar. 25, 2019, and 62/831,809, filed Apr. 10, 2019, all of which are incorporated herein in their entireties by specific reference for all purposes.

FIELD OF INVENTION

This invention relates to wood and wood composite lap and panel siding with an integrated rainscreen feature used on concrete wall or concrete masonry unit (CMU, or block) construction without the use of a weather resistant barrier (WRB) layer or a separate rainscreen.

BACKGROUND OF INVENTION

Wood or wood-composite based lap siding used on concrete wall or block construction (including, but not limited to, insulated concrete form construction) at present requires the use of a weather resistant barrier or layer (WRB) or a separate rainscreen (e.g., furring or batten strips). In addition to the increased cost and labor required, such systems also resulted in compromised drainage capability. For example, a typical woven, mat-style rain screen, often used behind wood-based siding on concrete/block construction, becomes compressed at the point of attachment (such as where, where lap siding overlaps), which causes increased moisture absorption at that point, leading to staining and deterioration in the performance and structure of the siding (see FIG. 1). Accordingly, what is needed is a lap siding or similar product that does not require the use of a weather resistant barrier or layer (WRB) or a separate rainscreen (e.g., furring or batten strips) when used on concrete wall or block construction.

SUMMARY OF INVENTION

In various exemplary embodiments, the present invention comprises wood or wood-composite based siding used on concrete wall or concrete masonry unit (CMU, or block) construction (including, but not limited to, insulated concrete form construction) with an integrated rainscreen feature. The siding thus does not require the use of a WRB layer or a separate rainscreen (e.g., furring or batten strips). Additionally, the present invention is complementary to, and improves the performance of, woven-mesh style WRBs which are subject to diminished performance due to compression when siding is attached.

While the embodiments discussed below are in the context of wood or wood-composite based lap or panel siding, the present invention can be applied to complementary products, such as trim materials or pieces, made from the same or different materials. Further, in some embodiments the invention may be used with non-wood based materials. For example, the drainage features of the present invention may be applied to and/or incorporated into, and will provide increased airflow and moisture/water drainage benefits to, siding made from fiber cement, fiberglass, reinforced polymer composite, poly-ash composite, vinyl, and similar materials.

In several embodiments, for lap-style siding, the product self-indexes to provide the correct reveal. This unique, innovative features provides a cost savings in both labor and material while still providing moisture management (i.e., drainage) and ensuring no direct contact between the wood-based siding and the concrete surface (either of which could result in reduced service life of the siding material). The present invention thus allows wood-based siding materials to be used in place of non-wood siding materials where the absence of a WRB between the concrete/CMU is not required by building codes. A requirement to use a WRB by a wood-based siding manufacturer, in the absence of a code requirement, would be an inconvenience to the builder (installer) and increase installation costs.

In several embodiments of the present invention, a rainscreen feature or component is applied to, or integrated into or with, the back of the siding (i.e., the inner surface) during the manufacturing process, or in a secondary process thereafter. In some embodiments, the features comprise raised elements, strips or ridges from approximately 1/16 to approximately ¾ inches tall, with one or more channels or spaces. No job-site assembly is required, thereby reducing time and cost.

The material used to fabricate the rainscreen component permits fasteners (e.g., nails, screws, and the like) to be applied through the siding and/or the component and into the wall. The material also resists compression, thereby maintaining an effective drainage plane while keeping the wood from contacting the concrete (common mat-style independent wall drainage plane systems, such as woven polyester, can be compressed during installation, especially in areas around a fastener).

DETAILED DESCRIPTION OF EXEMPLARY EMBODIMENTS

Figure 1B:
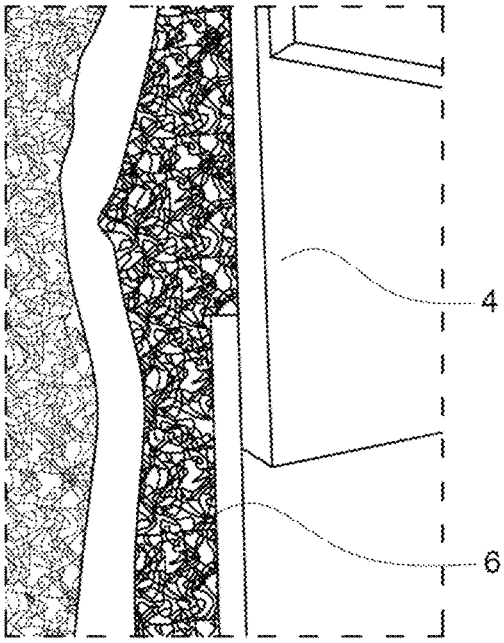
FIG. 1B (PRIOR ART)
FIGS. 1A-C shows side views of an examples of a prior art woven-mesh WRB layer under lap siding.
Figure 1C:
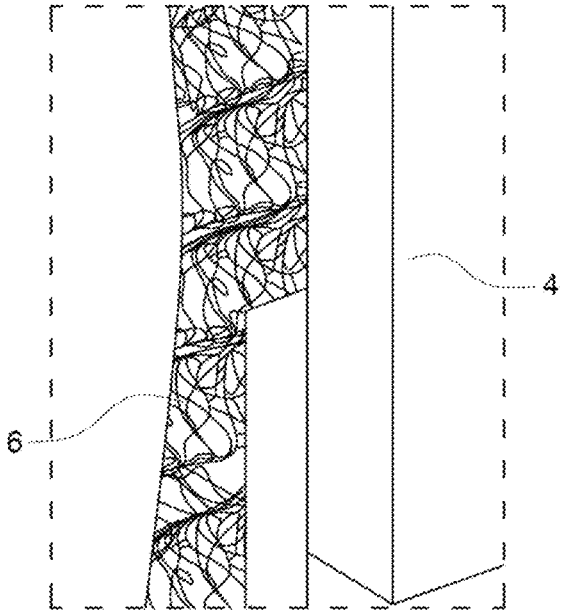
FIG. 1C (PRIOR ART)
Figure 1A:
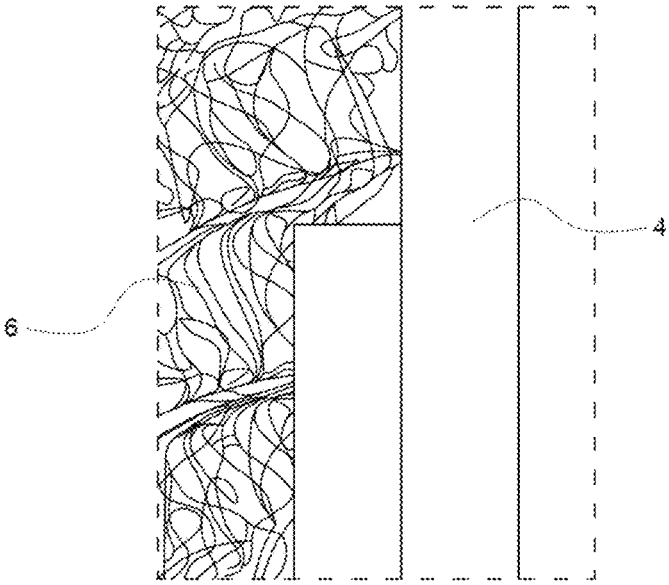
FIG. 1A (PRIOR ART)

In various exemplary embodiments, the present invention comprises wood or wood-composite based siding 4 used on concrete wall or concrete masonry unit 2 (CMU, or block) construction (including, but not limited to, insulated concrete form construction) with an integrated rainscreen feature. The siding thus does not require the use of a WRB layer or a separate rainscreen (e.g., furring or batten strips). Additionally, the present invention is complementary to, and improves the performance of, woven-mesh style WRBs 6 which are subject to diminished performance due to compression when siding 4 is attached, such as seen in FIGS. 1A-C.

While the embodiments discussed below are in the context of wood or wood-composite based lap or panel siding, the present invention can be applied to complementary products, such as trim materials or pieces, made from the same or different materials. Further, in some embodiments the invention may be used with non-wood based materials. For example, the drainage features of the present invention may be applied to and/or incorporated into, and will provide increased airflow and moisture/water drainage benefits to, siding made from fiber cement, fiberglass, reinforced polymer composite, poly-ash composite, vinyl, and similar materials.

In several embodiments, for lap-style siding, the present invention self-indexes to provide the correct reveal. This unique, innovative features provides a cost savings in both labor and material while still providing moisture management (i.e., drainage) and ensuring no direct contact between the wood-based siding and the concrete surface (either of which could result in reduced service life of the siding material). The present invention thus allows wood-based siding materials to be used in place of non-wood siding materials where the absence of a WRB between the concrete/CMU is not required by building codes. A requirement to use a WRB by a wood-based siding manufacturer, in the absence of a code requirement, would be an inconvenience to the builder (installer) and increase installation costs.

In several embodiments of the present invention, a rainscreen feature or component 10 is applied to, or integrated into or with, the back of the siding 4 (i.e., the inner surface) during the manufacturing process, or in a secondary process thereafter. In some embodiments, the features comprise raised elements, strips or ridges from approximately 1/16 to approximately ¾ inches tall, with one or more channels or spaces. No job-site assembly is required, thereby reducing time and cost.

The material used to fabricate the rainscreen component permits fasteners (e.g., nails, screws, and the like) to be applied through the siding and/or the component and into the wall. The material also resists compression, or is substantially incompressible in normal installation with customary fasteners, thereby maintaining an effective drainage plane while keeping the wood-based siding from contacting the concrete (common mat-style independent wall drainage plane systems, such as woven polyester, can be compressed during installation, especially in areas around a fastener, thereby allowing part of the wood-based siding to contact the concrete).

Figure 2:
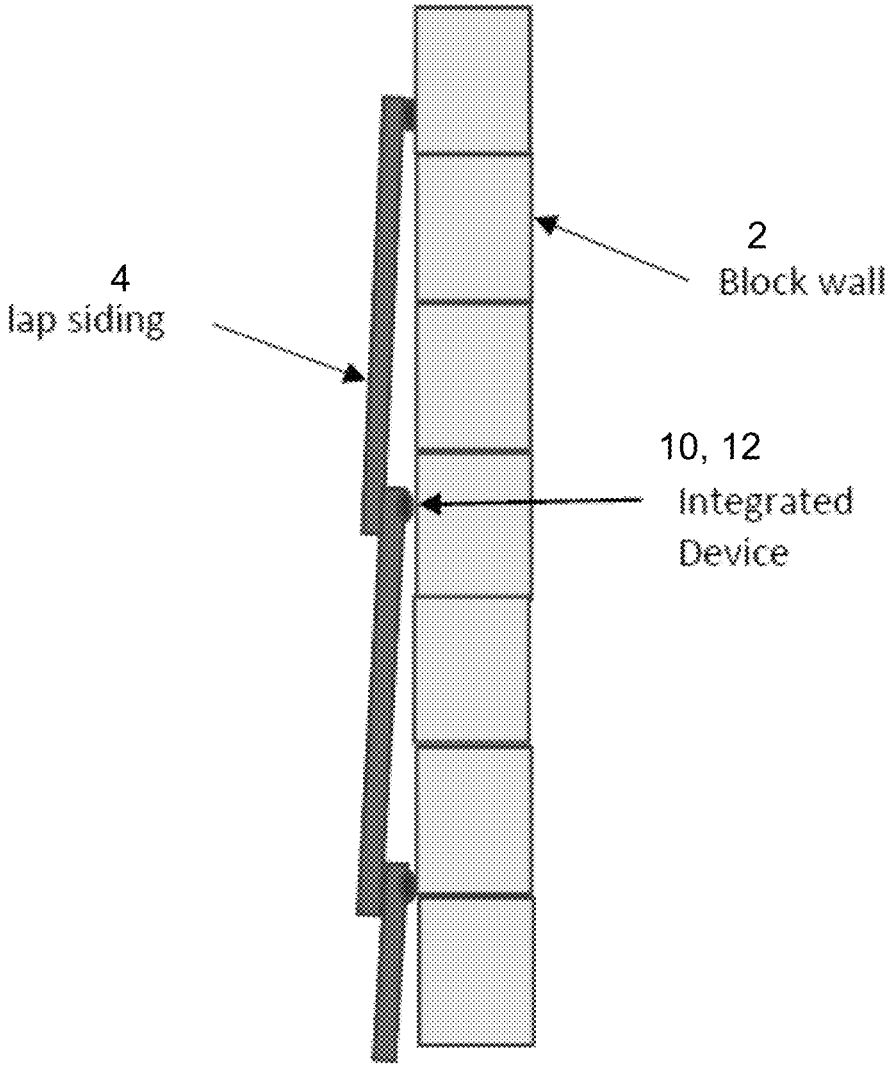
FIG. 2 shows a side view of a product in accordance with an embodiment of the present invention.
Figure 5:
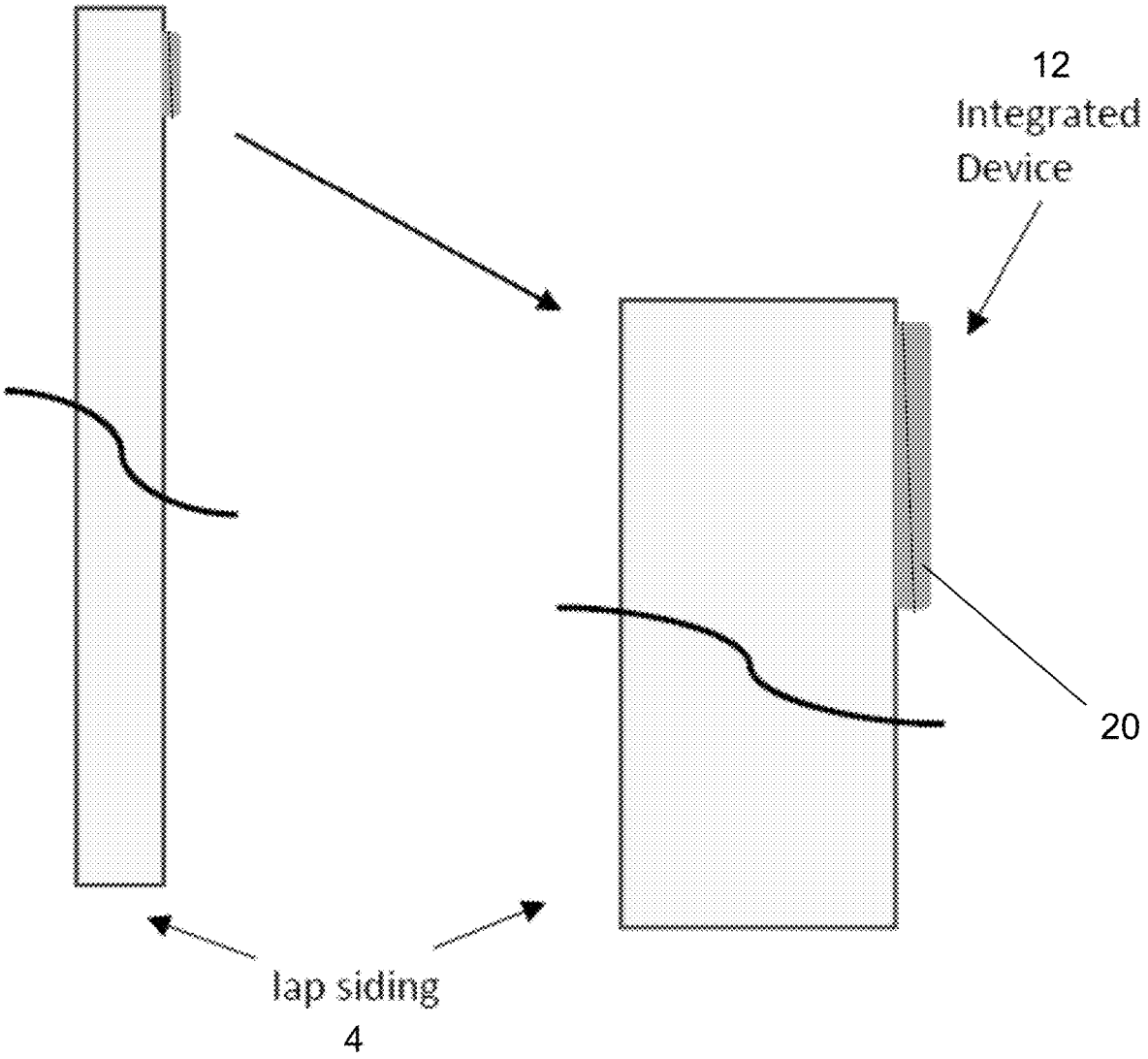
FIG. 5 shows a side views of another product in accordance with an embodiment of the present invention.

FIGS. 2 and 5 show a side view of examples of integrated features 10, 12 affixed or fastened to the inner surface (back surface) along or proximate to the upper edge of lap siding 4. The feature keeps the lap siding, which is wood-based, from contacting the concrete or block wall 2.

Figure 4:
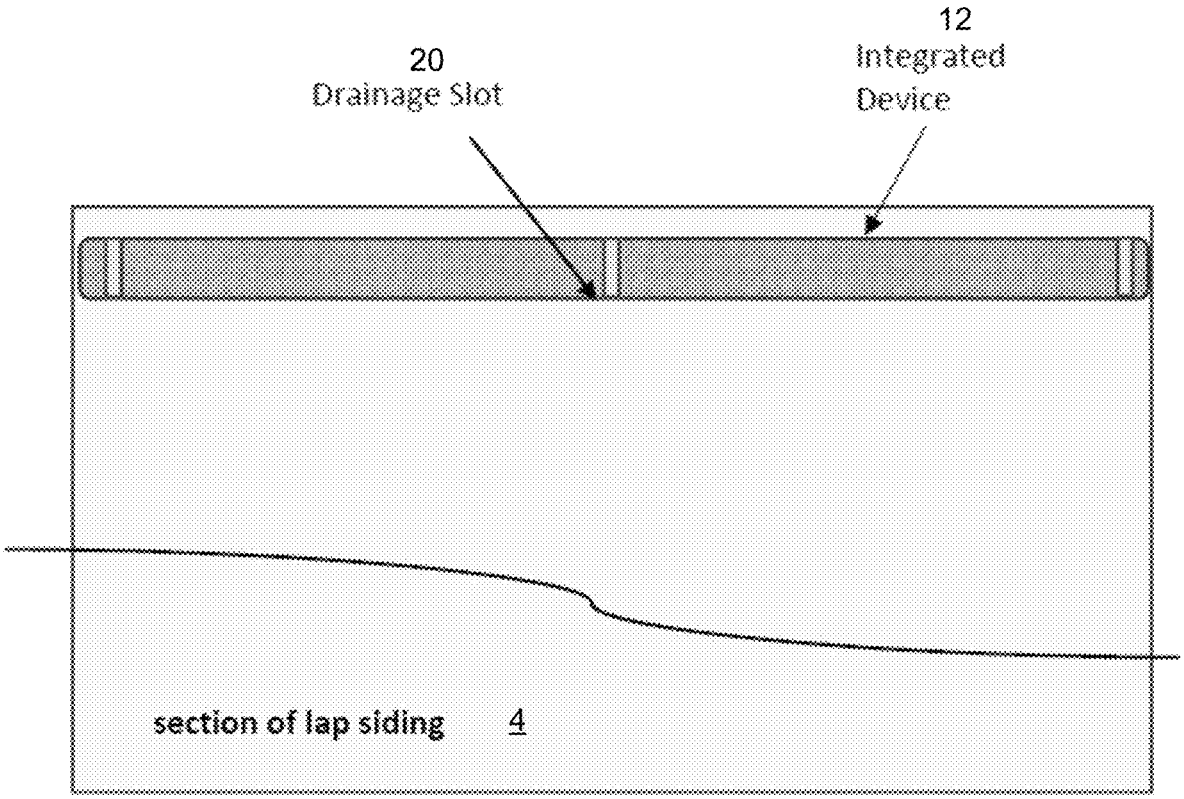
FIG. 4 shows a back face view of a product in accordance with an embodiment of the present invention.

FIG. 4 shows an example of a rainscreen feature in the form of a continuous linear strip 12 of plastic, high impact polystyrene, polyethylene, or similar material with recessed areas or drainage slots 20 (cut, melted, or otherwise preformed during the molding process) to allow water or moisture to flow or pass by the integrated rainscreen feature. The strip feature is affixed along or proximate to the top edge of the inner/back face of the siding, and may be (but is not required to be) uniformly or consistently thicker, and recessed to minimize that the overall siding thickness in the vicinity of the strip. In an alternative embodiment, the strip may be in several pieces with gaps therebetween in lieu of drainage slots.

Figure 6:
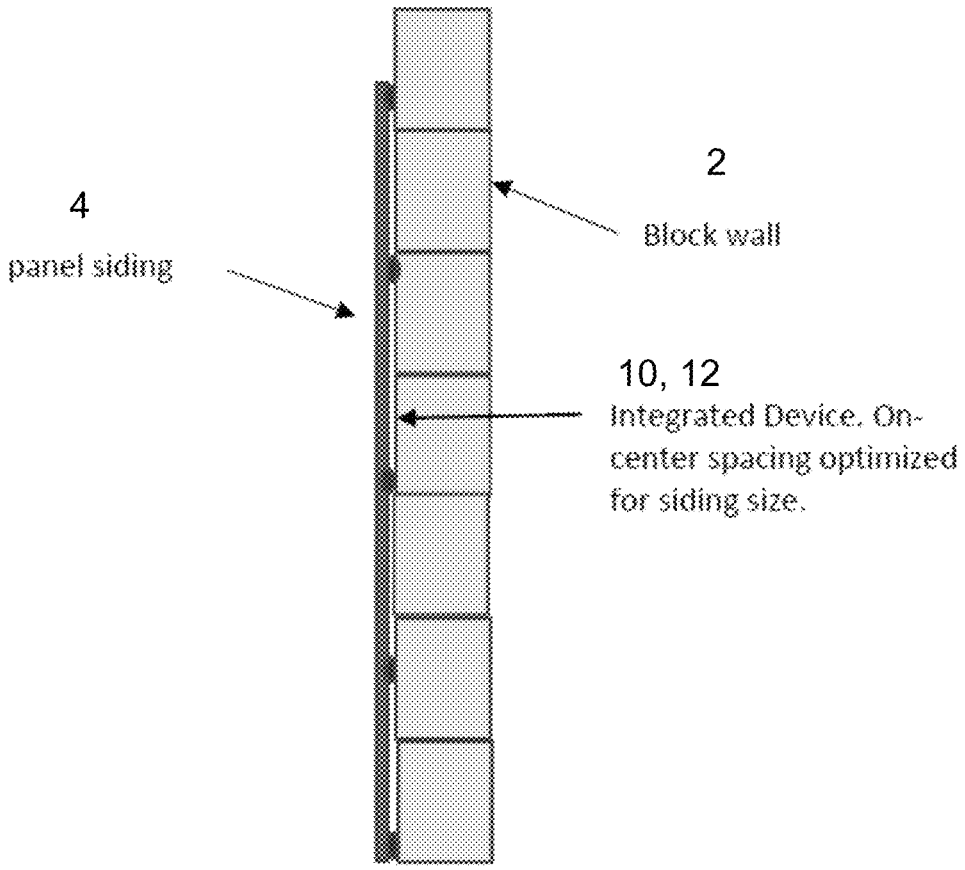
FIG. 6 shows a side view of another product in accordance with an exemplary embodiment of the present invention.
Figure 7:
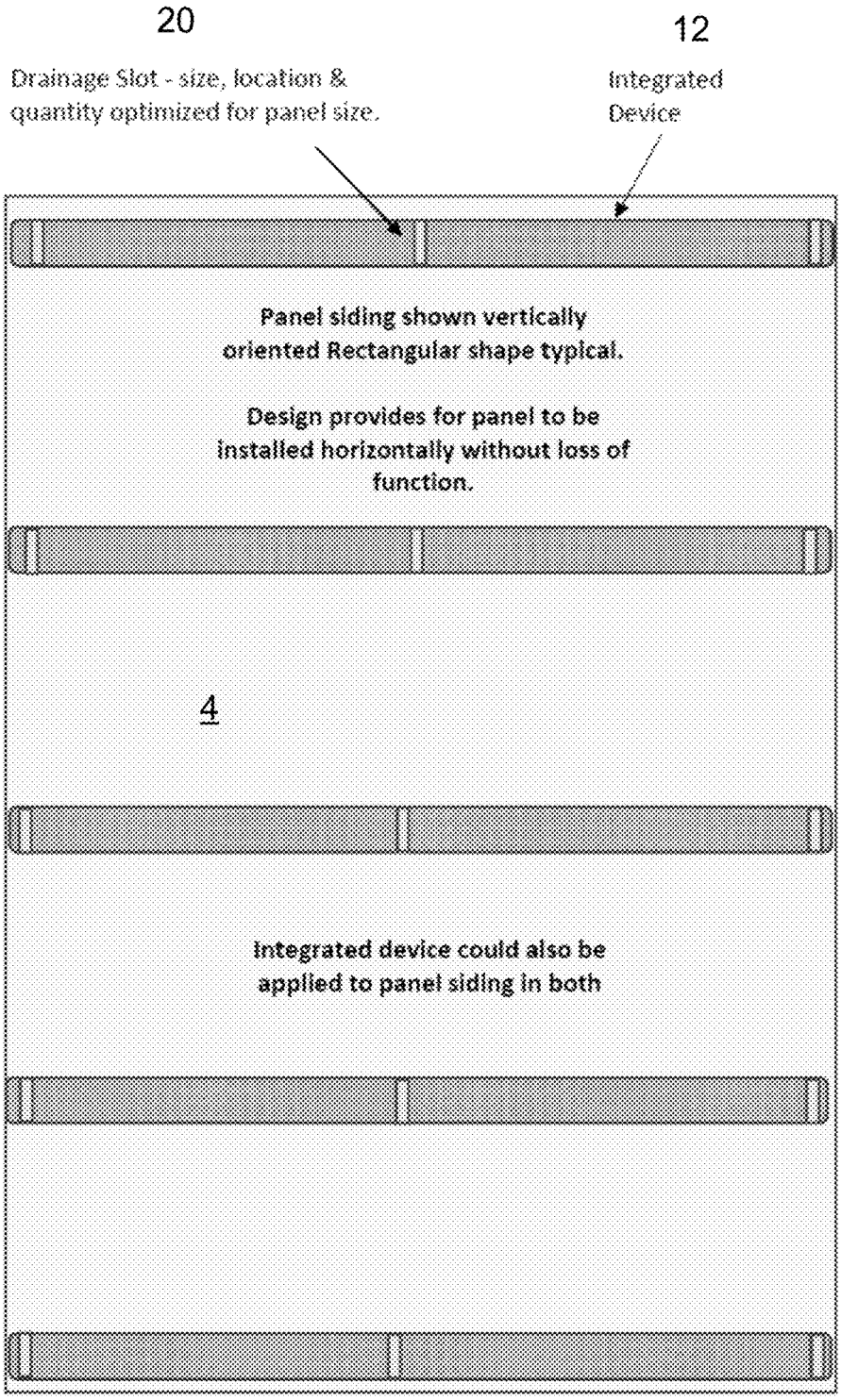
FIG. 7 shows a back face view of a product in accordance with an embodiment of the present invention.

FIG. 6 shows a side view of examples of integrated features affixed or fastened to the inner surface (back surface) at various locations on panel siding. FIG. 7 shows an example of multiple strip features with drainage slots positioned at various location on the back surface of a piece of panel siding.

Figure 8:
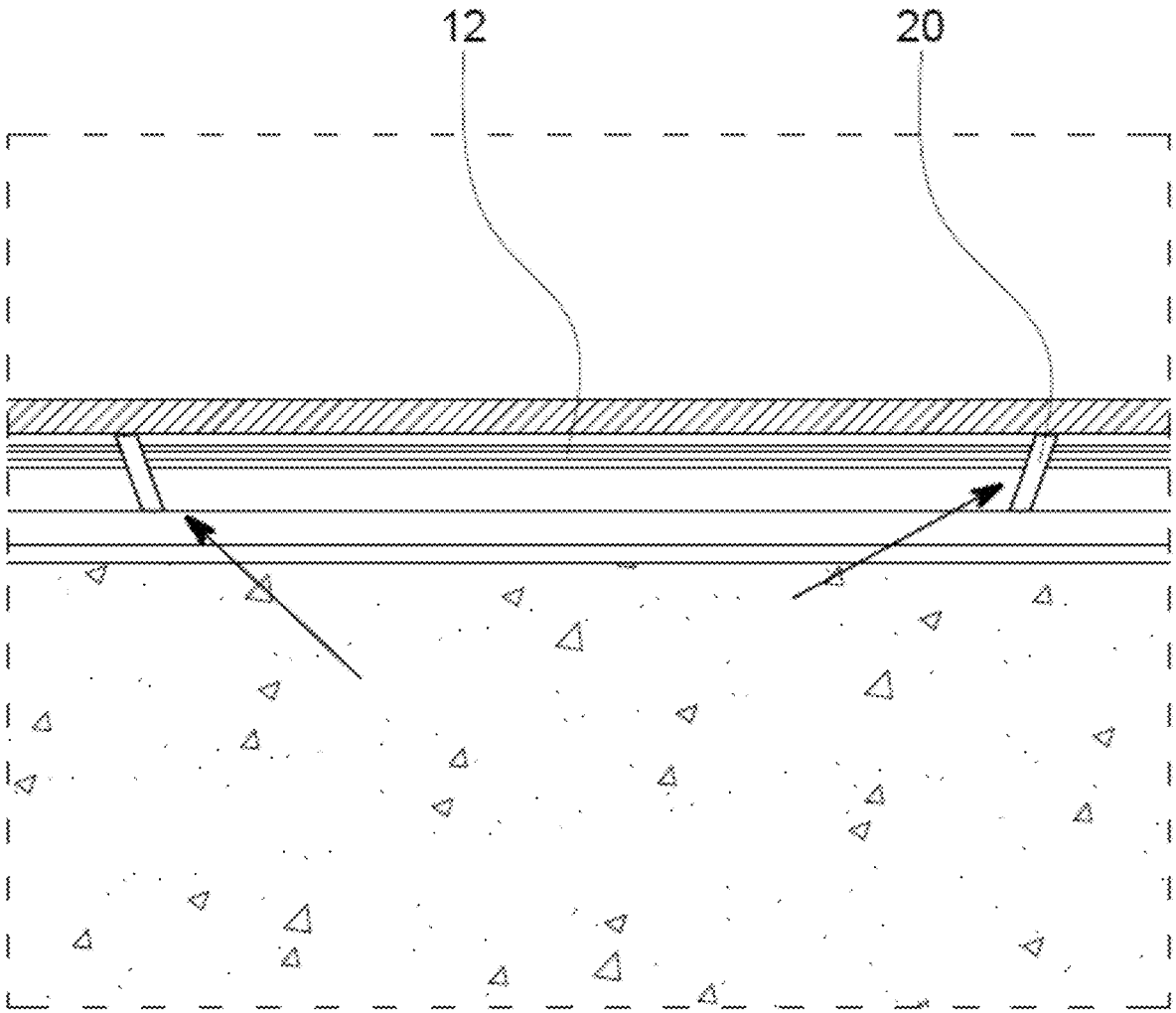
FIGS. 8-17 show various views of integrated rainscreen features in accordance with embodiments of the present invention.
Figure 9:
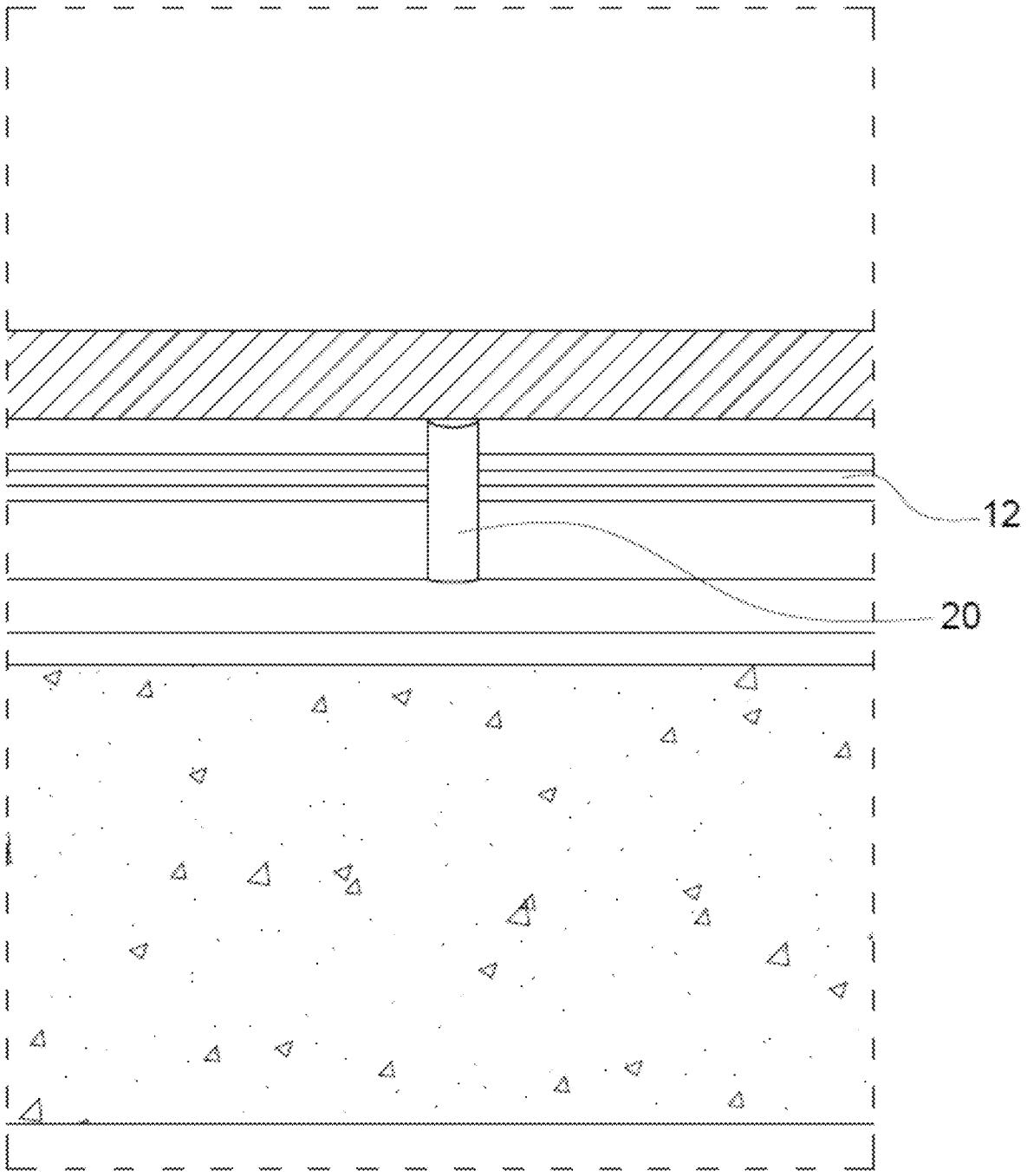
Figure 10:
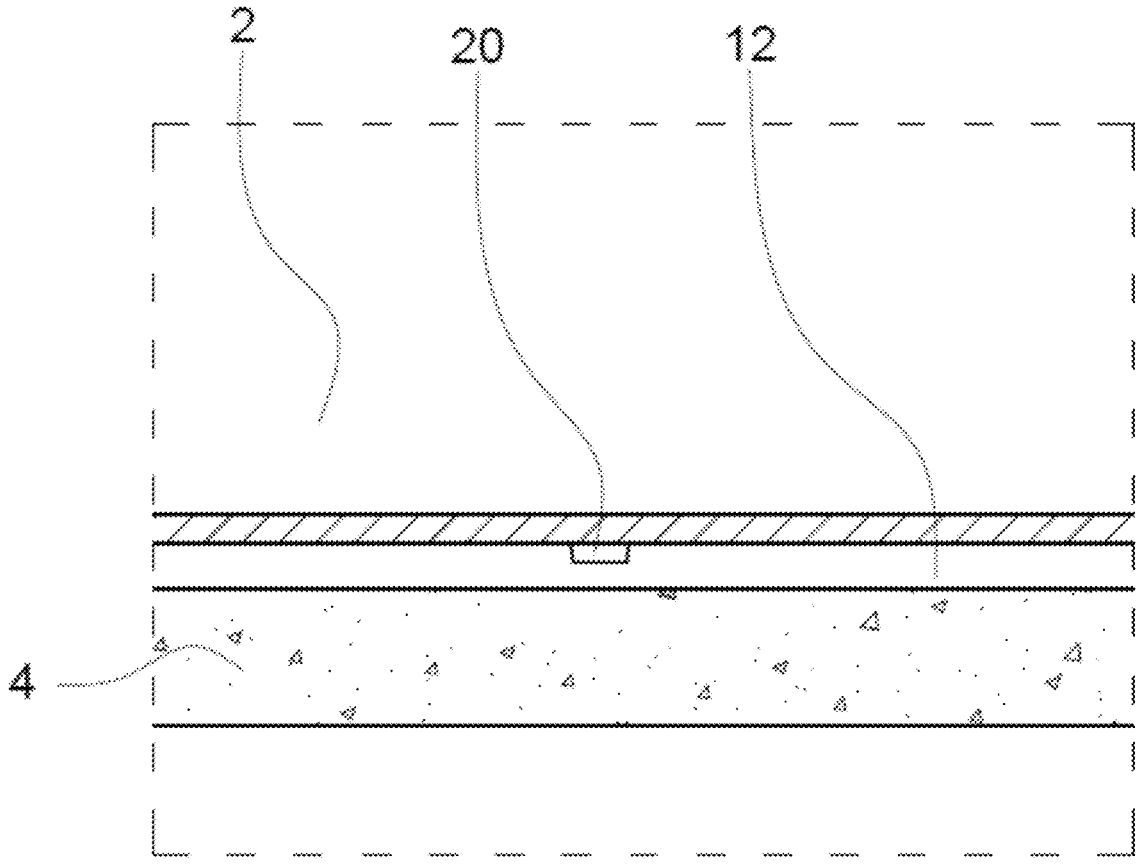
Figure 11:
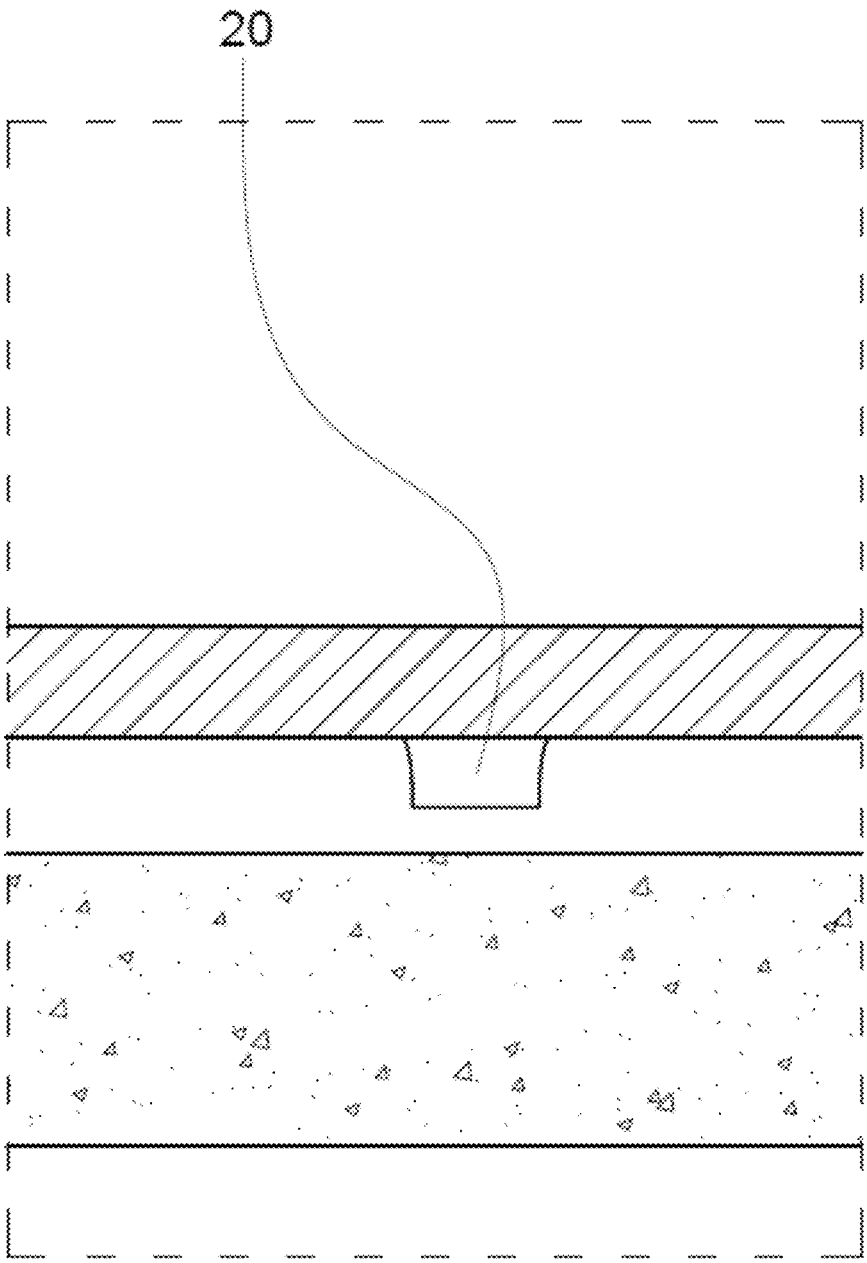

FIG. 8 shows another example of a strip feature with drainage slots along the top edge, inner/back side, of a piece of siding. FIG. 9 shows a close-up of a drainage slot or channel. The drainage slot or channel size (width and/or depth), shape, angle, density/quantity (i.e., number per lineal foot) may vary. FIGS. 10 and 11 show a top view and close-up view, respectively, of the linear strip (dark) with a drainage slot/channel, after attachment of siding (bottom) to a CMU wall (top). In several embodiments, the rainscreen feature is indexed to, or proximate to, the top edge of the siding.

Figure 3:
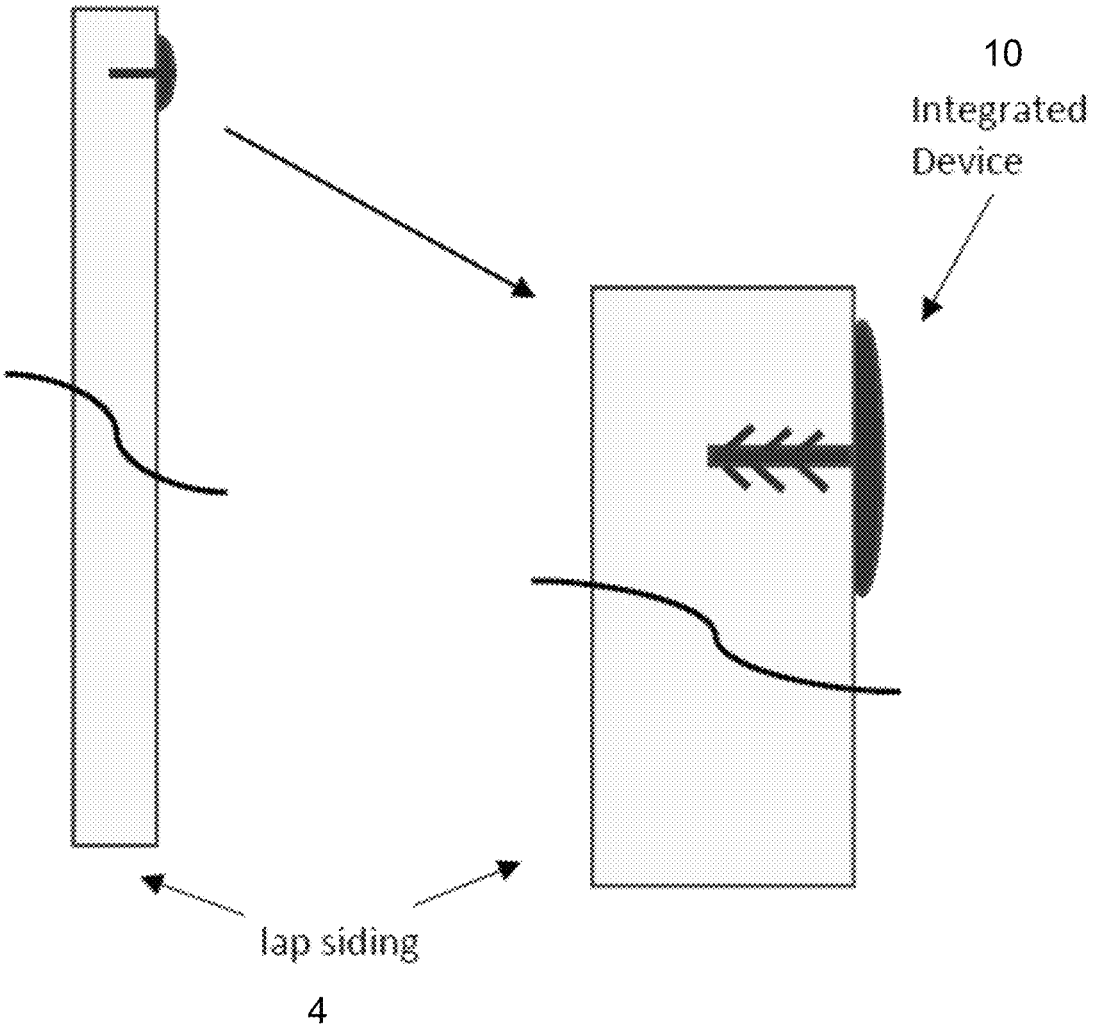
FIG. 3 shows a side view of another product in accordance with an embodiment of the present invention.
Figure 12:
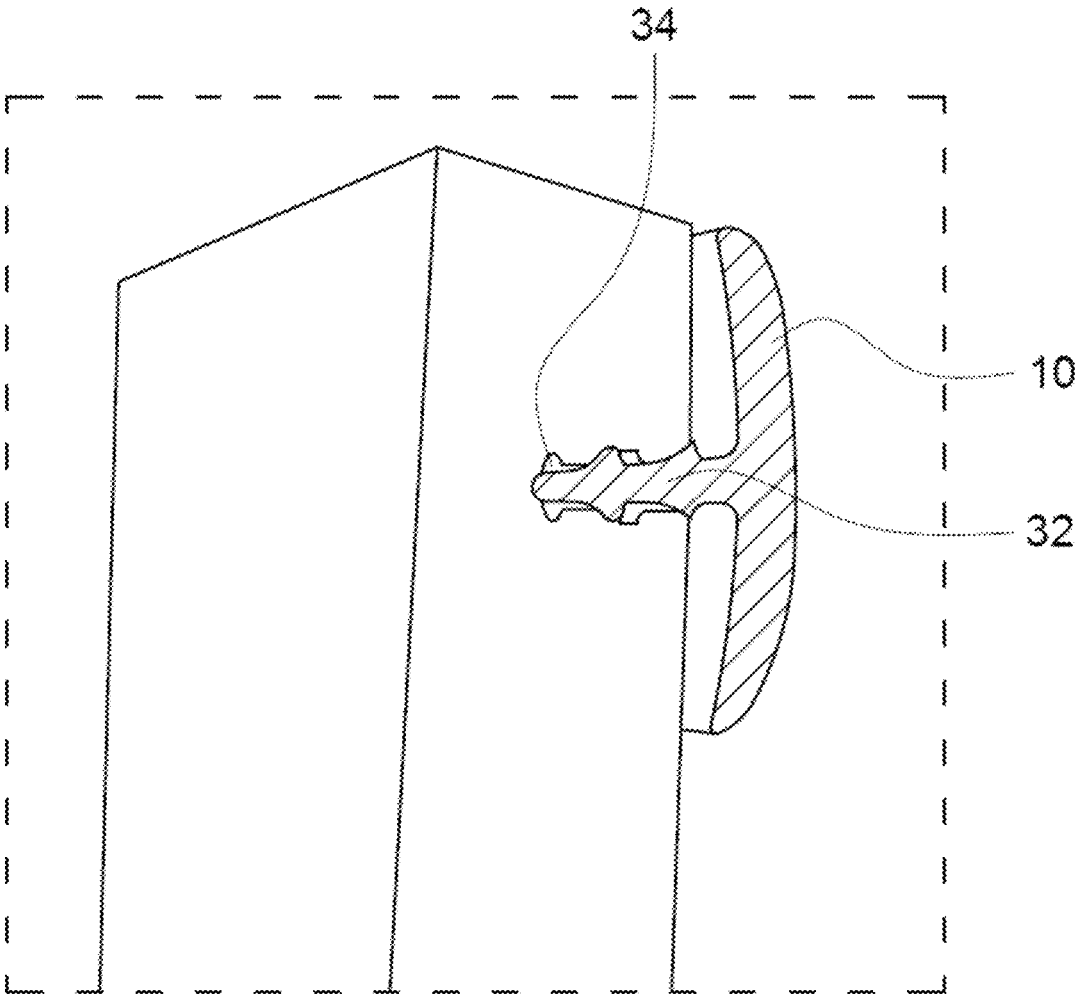

FIGS. 3 and 12 show an alternative embodiment of a linear rainscreen feature 10 modified to facilitate a high-speed manufacturing process (i.e., the strip does not necessarily have to be indexed to the top edge of the siding). The strip 10 has a curved, convex outer face or head (in cross-section), with a spline 32 (or splines) inserted into a machined groove, slot or hole (or holes). In the embodiment shown, the spline has barbs or directionally-biased angled elements which may be used to create a friction fit when inserted into the machine groove 34, thereby holding the feature in place securely without the use of adhesives. In several embodiments, adhesives may be used to secure the strip to the siding. Drainage depressions or spacing of separate parts may be used, as described above. The curvature of the head improves installation of the siding on irregular surfaces, and helps provide flexibility for siding angles that vary with the lap-siding reveal chosen.

Figure 13:
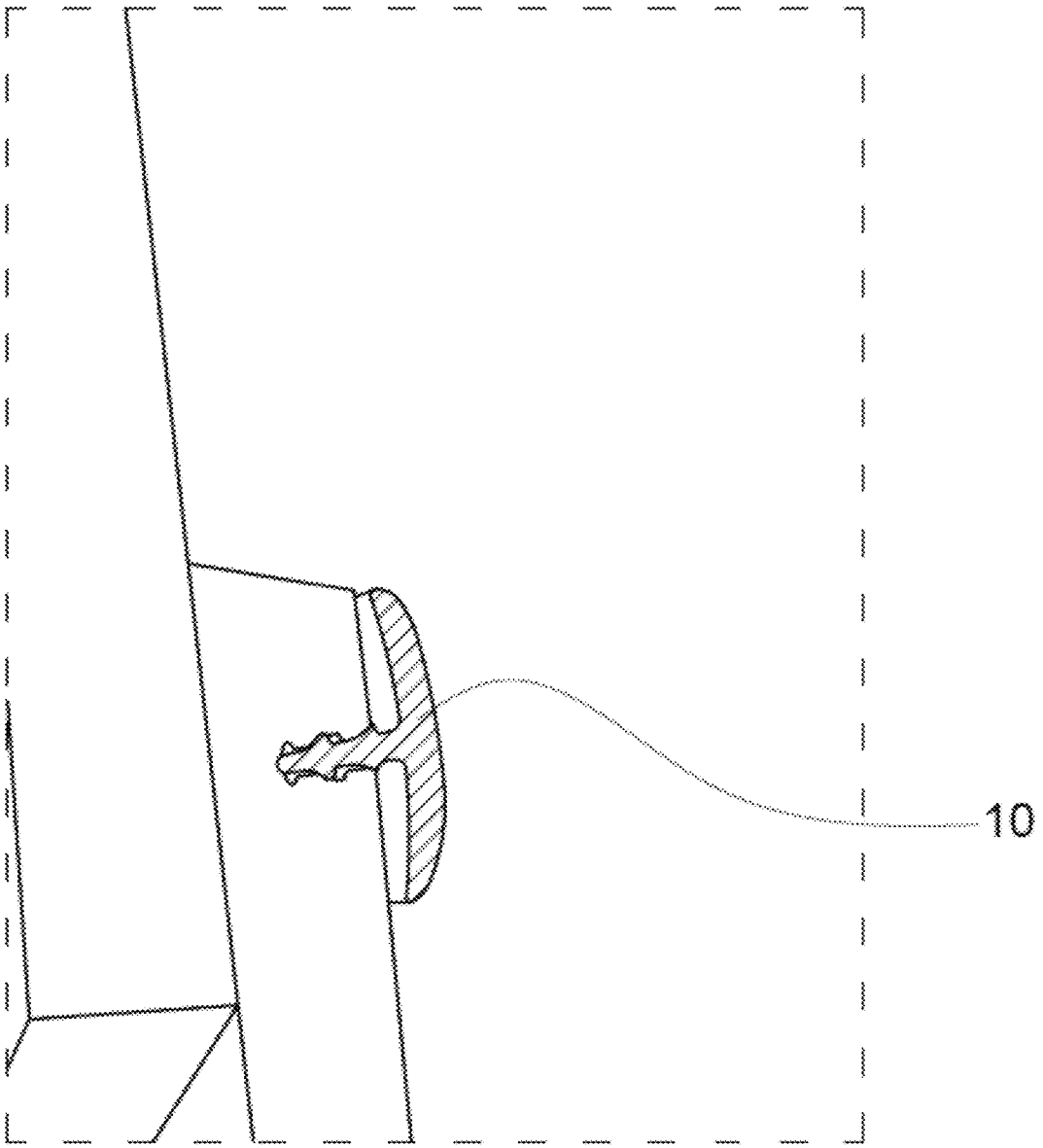
Figure 14:
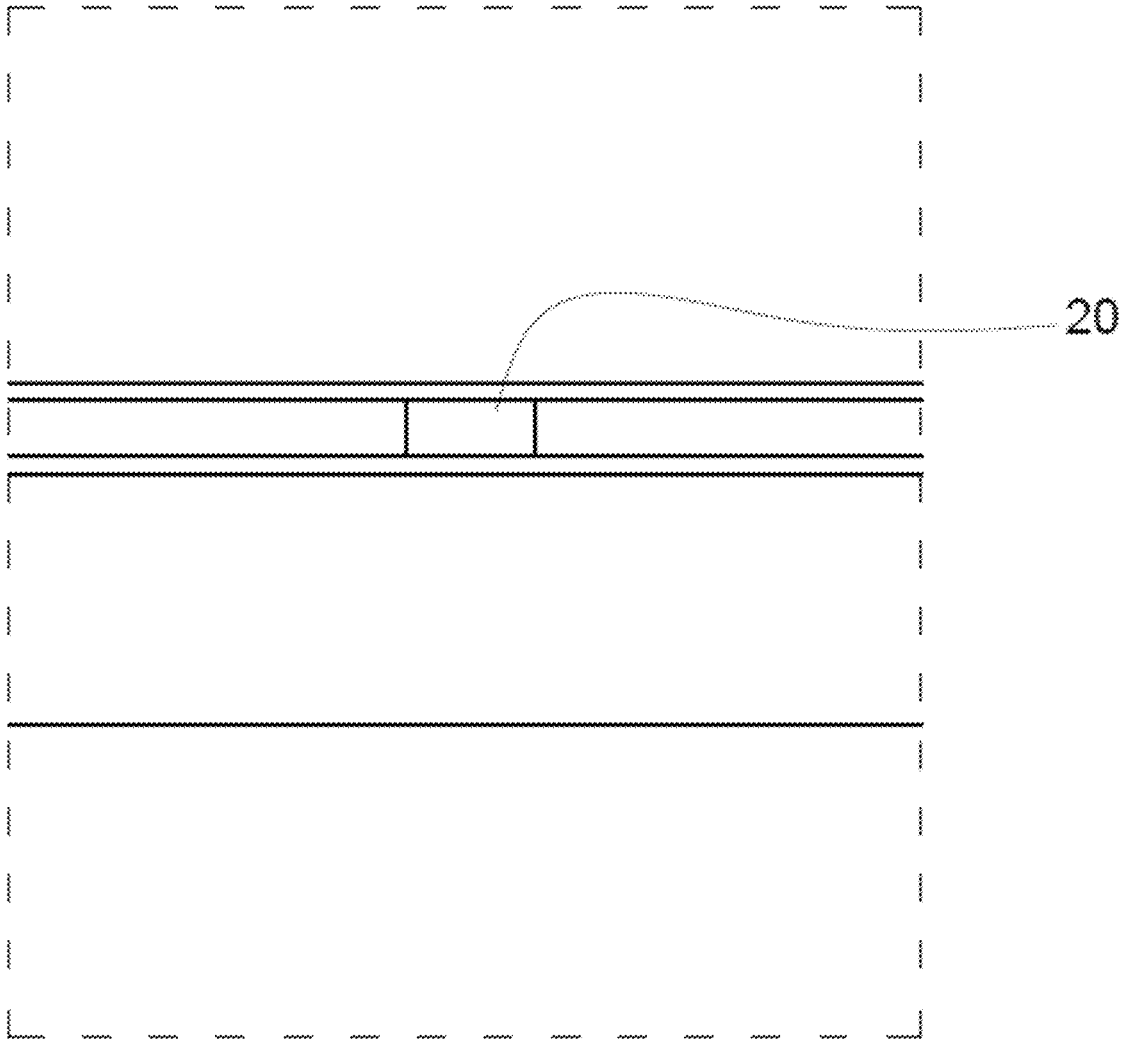

FIG. 13 shows a close-up of a successive course of lap siding 4 overlapping a piece of lap siding with the linear rainscreen feature 1 of FIGS. 3 and 12. FIG. 14 shows a top view of a drainage gap or channel 20 after siding is attached to a CMU block wall 2 (top). The drainage channel 20 may be the full thickness of the component or less than the full thickness. In one embodiment, the channel 20 is tapered to have a varying depth in relation to the component. As an example, a deeper channel may be present at the top and a less deep channel may be present at the bottom (the channel may be deeper at the top and shallower at the bottom).

Figure 15:
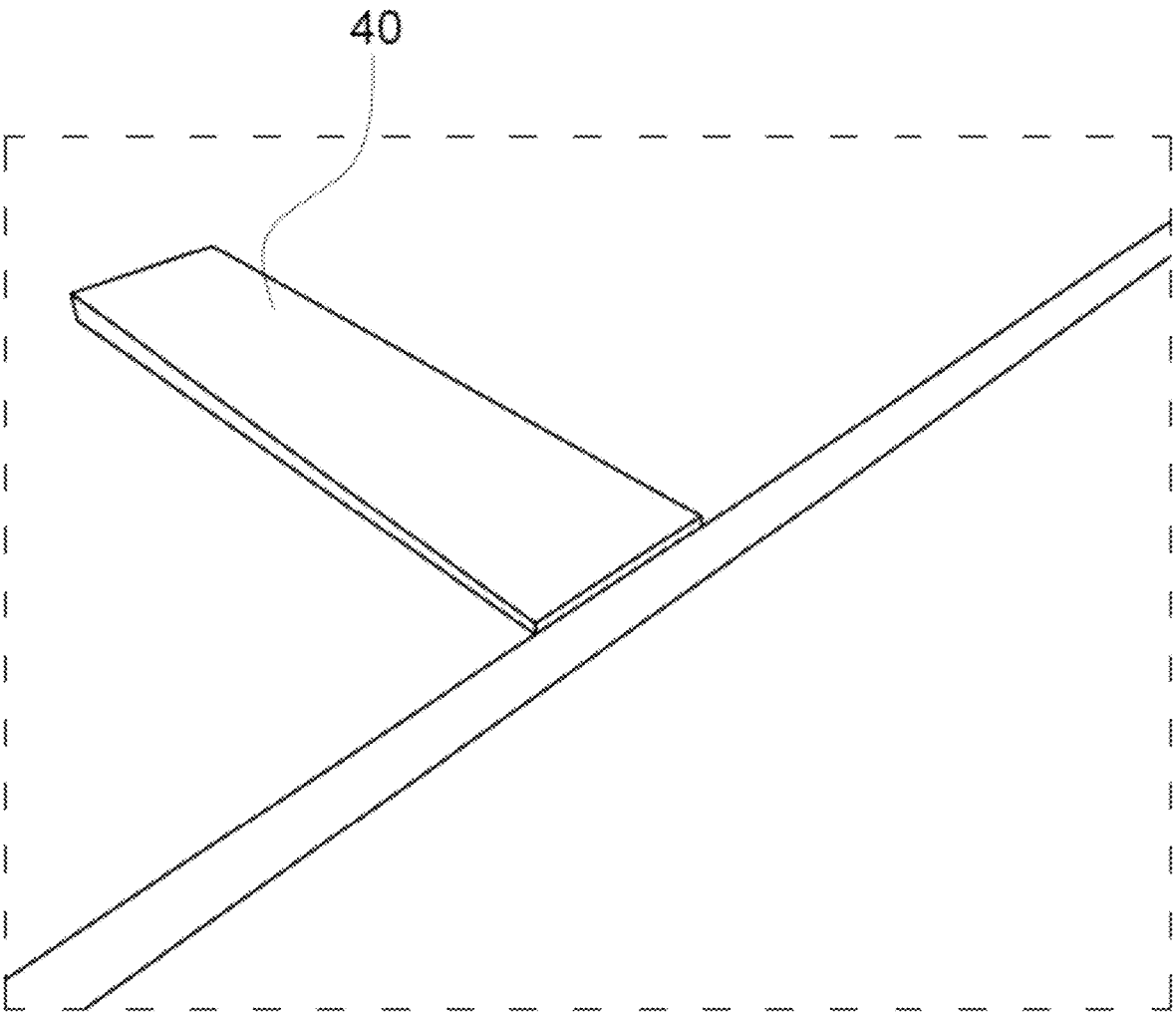
Figure 16:
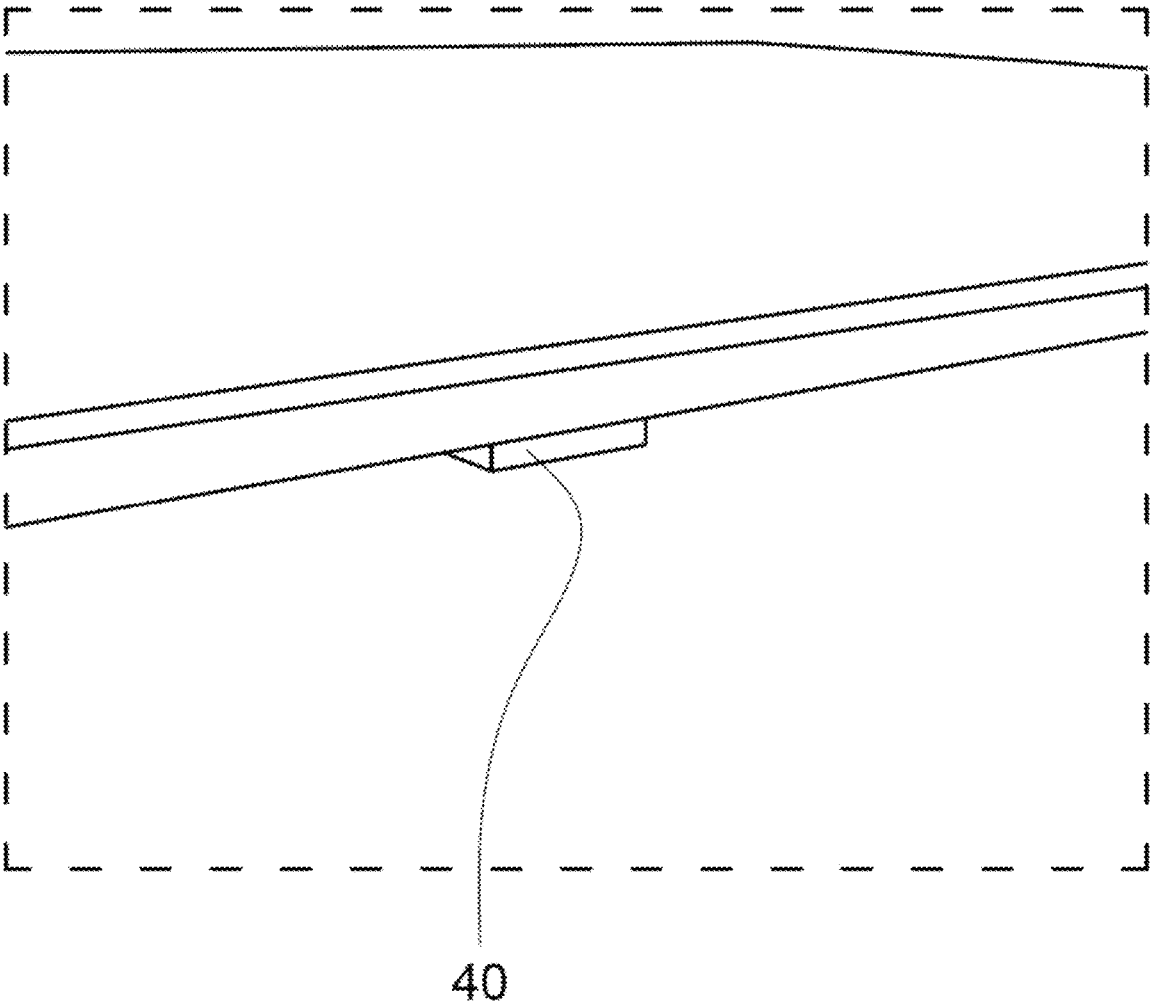
Figure 17:
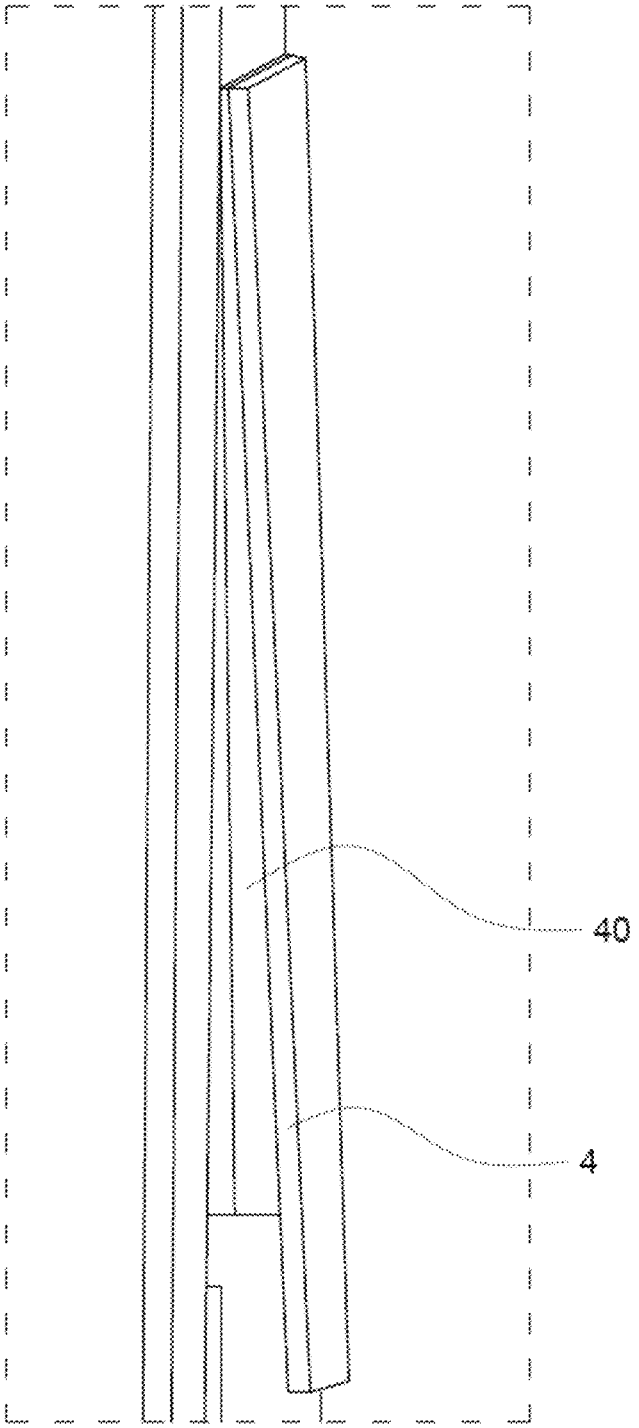

In yet another alternative embodiment, a custom-sized, wedge-shaped plastic (or similar material) element or feature 40 is affixed to the inner/back face of the siding at a prescribed spacing (e.g., 16" on center), as seen in FIG. 15. The wedge extends down from the top edge of the siding to a prescribed length (which may be some or all of the height of the inner/back face. The wedge may be thinner near the top edge and gradually increase to its thickness dimension at the distal end. In the embodiments shown in FIGS. 15-17, the wedge 40 extends down a prescribed length sufficient to index the row of siding with the correct overlap (i.e., reveal) of the preceding row of siding. FIG. 15 shows an example of a single wedge, although other styles and positioning are within the scope of the invention. FIG. 16 shows a top perspective view illustrating the gap created between the siding and the wall (shown as OSB in this figure for illustration purposes only). Water flows through the large gaps between the wedges. FIG. 17 shows a side profile with the wedge 40 preventing the siding 4 from touching the wall (on the left), and indexing that row of siding with the correct reveal.

Figure 18:
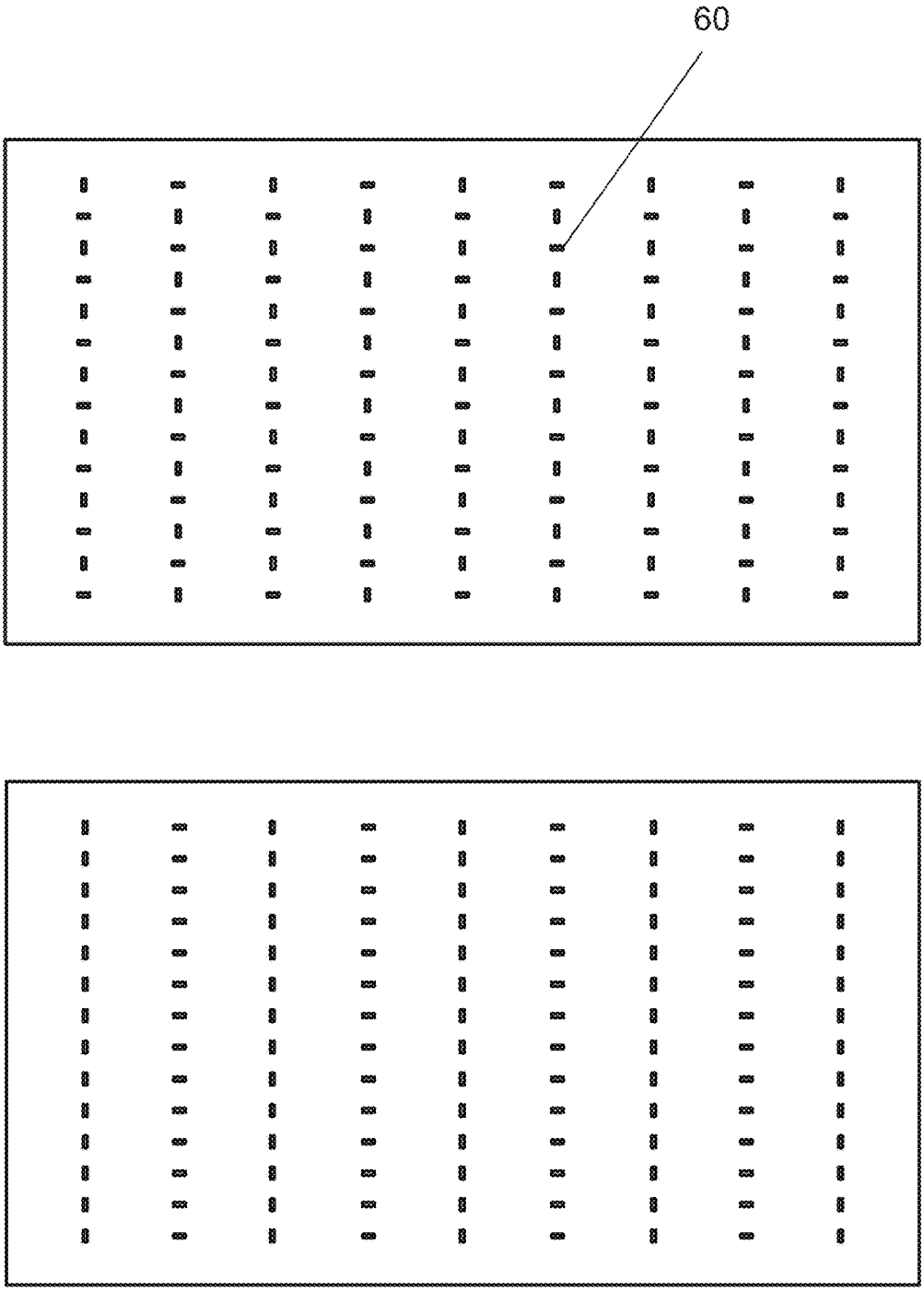
FIG. 18 shows back face views of a product with liquid-applied rainscreen features in accordance with an embodiment of the present invention.

Liquid-applied strips, dots, or other suitable shapes 60 can be substituted for pre-formed rigid materials described above, provided that the material is not compressible after it dries, hardens, or cures. As seen in FIG. 18, the features may be uniform or predictable in general shape and size (or patterning), to ensure the features do not interfere with the fastening system being used, and to ensure that the siding/cladding lies uniformly flat on the wall. Different sizes, shapes, orientations, and patterns than those shown may be used. This embodiment may be applied to various forms of siding, including, but not limited to, lap and panel style siding.

The integrated rainscreen component allows water to more easily drain and run off behind the siding along the drainage plane provided by the concrete or CMU wall. The design of the rainscreen element also allows the siding products to be stacked and shipped normally with no damage to the siding products or rainscreen features.

The present invention possess several advantages over the prior art. It provides a savings in time and labor as the siding (cladding) installer is not required to apply (i.e., install) either a WRB or traditional rainscreen to the wall. Further, pre-applying the integrated rainscreen features to the wood or wood-based siding product in a controlled setting (e.g., manufacturing facility) allows efficient, precise, and consistent application of the integrated rainscreen, with opportunity to fully bond to the siding product to which it is applied. More specifically, the integrated rainscreen components can be applied to a siding product without interference from construction-related dirt, debris, humidity, or weather conditions. These enhancements increase system performance, installation reliability and structure durability while decreasing construction related waste. It also reduces the number of SKUs and materials needed to be delivered and stored at a jobsite.

An example of the effectiveness of the present invention is provided below. A set of engineered wood-based siding samples with an integrated device as shown in FIG. 5 was exposed to a damp concrete surface in an enclosed apparatus to maximize air humidity and concrete block moisture. A matching set of control siding samples without the integrated device were similarly placed into direct contact with the damp concrete surface. Weight measurements of the samples were taken before and during the exposure period (to the nearest 0.1 gram) of 5 days. Weight measurements were taken every 4 hours for the first 12 hours of the exposure period, and approximately every 12 hours thereafter through the remainder of the exposure period.

After 122 hours of exposure, the control samples had an average weight gain of 2.5 times that of the samples with the integrated device. Further, the rate of moisture absorption for control samples was higher than for the samples with the integrated device. Additionally, the control samples had visible surface moisture (i.e., free water on their surfaces) present, while the samples with the integrated device did not. All samples had a base slight gain in moisture content due to the ambient humidity, where moisture is bound to the wood fibers and unavailable to support fungal decay. The samples with an integrated device had an oven dry moisture content of 25% on the exposed surface, while the control samples had an oven dry moisture content of 57%.

The presence of free moisture and a wood moisture content above 30% on the exposed surface are conditions known to support fungal decay. This example demonstrate that the device of the present invention can be used in lieu of traditional house wrap (e.g., WRB), and prevent engineered wood-based siding from exposure to levels of moisture that would support fungal decay.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A siding product for installation on a concrete wall or concrete masonry unit, comprising:

a piece of siding with a front face, a back face with a length and a height, a top edge, and a bottom edge, configured for installation on a concrete wall or concrete masonry unit;

one or more rainscreen wedges, each with an outer face and an inner face and a thin end and a thick end, disposed across the back face proximate the top edge, the one or more rainscreen wedges configured to contact the concrete wall or concrete masonry and prevent the piece of siding from coming into contact with the concrete wall or concrete masonry unit when installed thereon;

wherein each of the one or more rainscreen wedges does not extend the length and height of the back face;

wherein the inner face is flat.

2. The siding product of claim 1, wherein each rainscreen wedge thin end is proximate the top edge, and the wedge increases in thickness as it extends toward the bottom edge.

3. The siding product of claim 1, wherein the piece of siding is a piece of lap siding, and the one or more rainscreen wedges are self-indexing with respect to a second piece of lap siding.

4. The siding product of claim 1, wherein the thick end of each wedge on the piece of lap siding provides an index for placement of that piece of lap siding with respect to a second piece of lap siding.

5. The siding product of claim 1, wherein the one or more rainscreen wedges are substantially incompressible.

6. The siding product of claim 1, wherein the piece of siding comprises manufactured wood.

7. The siding product of claim 1, wherein the piece of siding comprises oriented-strand board.

8. The siding product of claim 1, wherein the one or more rainscreen wedges are adhesively affixed to the back of the piece of siding.

9. The siding product of claim 1, wherein the one or more rainscreen wedges are integrated with the piece of siding.

* * * * *